US009576753B2

(12) United States Patent
Babu et al.

(10) Patent No.: US 9,576,753 B2
(45) Date of Patent: Feb. 21, 2017

(54) MOVEABLE CONTACT ARM RELEASES LATCH PLATE ENGAGEMENT IN A CIRCUIT BREAKER

(71) Applicant: General Electric Company, Schenectady, NY (US)

(72) Inventors: Triplicane Gopikrishnan Babu, Hyderabad (IN); Maddela Rajesh Babu, Hyderabad (IN); Janakiraman Narayanan, Secunderabad (IN); Soundararajan Narayanasamy, Hyderabad (IN); Tanmay Pralhad Tamboli, Hyderabad (IN)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 5 days.

(21) Appl. No.: 14/740,545

(22) Filed: Jun. 16, 2015

(65) Prior Publication Data

US 2016/0372277 A1 Dec. 22, 2016

(51) Int. Cl.

| | |
|---|---|
| ***H01H 1/52*** | (2006.01) |
| ***H01H 3/46*** | (2006.01) |
| ***H01H 9/20*** | (2006.01) |

(52) U.S. Cl.

CPC ..... *H01H 3/46* (2013.01); *H01H 9/20* (2013.01); *H01H 2205/002* (2013.01)

(58) Field of Classification Search

CPC .... H01H 71/1054; H01H 71/505; H01H 9/20; H01H 2071/508; H01H 3/3015

USPC ..... 200/321–324, 400; 335/21, 22, 46, 165, 335/167, 168, 190

See application file for complete search history.

(56) References Cited

U.S. PATENT DOCUMENTS

| | | | | |
|---|---|---|---|---|
| 2,833,886 A | | 5/1958 | Goodwin | |
| 3,192,344 A | | 6/1965 | T. M. Cole | |
| 3,518,587 A | * | 6/1970 | Huggins ..... | H01H 71/1054 335/46 |

(Continued)

FOREIGN PATENT DOCUMENTS

SE 175730 C1 6/1961

OTHER PUBLICATIONS

US Notice of Allowance Office Action issued in connection with related U.S. Appl. No. 14/736,474 on Jul. 13, 2016.

(Continued)

*Primary Examiner* — Vanessa Girardi

(74) *Attorney, Agent, or Firm* — GE Global Patent Operation; Stephen G. Midgley

(57) ABSTRACT

A contact system of a circuit breaker includes a fixed contact. The contact system also includes a moveable contact arm assembly comprising at least one moveable contact arm having a moveable contact thereon, the moveable contact arm moveable to define a closed condition and a blow open condition. The contact system further includes a carrier assembly operatively coupled to the moveable contact arm. The contact system yet further includes a latch plate operatively coupled to the carrier assembly. The contact system also includes a trip shaft operatively coupled to the carrier assembly, the trip shaft having a non-circular region defining an engagement surface disposed in contact with the latch plate in the closed condition. The contact system further includes a biasing portion of the moveable contact arm configured to rotate the trip shaft out of engagement with the latch plate and into the blow open condition.

19 Claims, 4 Drawing Sheets

(56) References Cited

U.S. PATENT DOCUMENTS

| | | | | |
|---|---|---|---|---|
| 4,144,513 | A | 3/1979 | Shaffer et al. | |
| 4,251,702 | A * | 2/1981 | Castonguay | H01H 3/3026 200/400 |
| 4,281,303 | A | 7/1981 | Heft | |
| 4,524,339 | A | 6/1985 | Chabot | |
| 4,611,187 | A | 9/1986 | Banfi | |
| 4,618,745 | A * | 10/1986 | Thompson, III | H01H 71/522 200/401 |
| 5,363,076 | A | 11/1994 | Miller et al. | |
| 5,424,701 | A | 6/1995 | Castonguay et al. | |
| 5,534,674 | A | 7/1996 | Steffens | |
| 5,731,560 | A | 3/1998 | Nebon et al. | |
| 5,793,270 | A | 8/1998 | Beck et al. | |
| 5,912,605 | A | 6/1999 | Eberts | |
| 5,931,290 | A | 8/1999 | Wehrli, III et al. | |
| 6,015,959 | A | 1/2000 | Slepian et al. | |
| 6,069,544 | A | 5/2000 | Seymour et al. | |
| 6,072,136 | A | 6/2000 | Wehrli, III et al. | |
| 6,180,902 | B1 | 1/2001 | Kowalyshen et al. | |
| 6,326,868 | B1 | 12/2001 | Kranz et al. | |
| 6,437,670 | B1 | 8/2002 | Castonguay et al. | |
| 7,034,642 | B1 | 4/2006 | Rakus et al. | |
| 7,115,830 | B1 | 10/2006 | Weister et al. | |
| 7,368,677 | B2 | 5/2008 | Jones et al. | |
| 7,566,840 | B2 | 7/2009 | Sudhakar et al. | |
| 7,633,031 | B2 | 12/2009 | Wehrli, III et al. | |
| 8,507,817 | B2 | 8/2013 | Gottschalk et al. | |
| 2008/0257702 | A1 * | 10/2008 | Weister | H01H 71/505 200/400 |
| 2009/0072933 | A1 | 3/2009 | Bonetti et al. | |
| 2009/0128265 | A1 | 5/2009 | Sudhakar et al. | |
| 2015/0311009 | A1 * | 10/2015 | Ding | H01H 3/3015 218/140 |

OTHER PUBLICATIONS

European Search Report issued in connection with related EP Application No. 16173283.9 on Oct. 17, 2016.

European Search Report and Opinion issued in connection with corresponding EP Application No. 16173873.7 on Nov. 9, 2016.

* cited by examiner

MOVEABLE CONTACT ARM RELEASES LATCH PLATE ENGAGEMENT IN A CIRCUIT BREAKER

BACKGROUND OF THE INVENTION

The subject matter disclosed herein relates to circuit breakers and, more particularly, to a contact system of a circuit breaker.

An electrical switching apparatus, such as a circuit breaker, provides protection for electrical systems from electrical fault conditions such as, for example, current overloads, short circuits, abnormal voltage and other fault conditions. Typically, circuit breakers include a housing and an operating mechanism which opens separable electrical contacts to interrupt the flow of current through the conductors of an electrical system in response to certain fault conditions.

To maintain a high withstand current rating, the contacts must be maintained in a closed condition at the current withstand rating. On the other hand, the short circuit let-through current must be capable of opening the contacts quickly during a short circuit condition. The drawback of having the contacts clamped or otherwise maintained in a tight closed condition is that the contacts may not be able to open quickly at the short circuit current level that the circuit breaker is rated for. Therefore, it is desirable to reliably disengage the contacts to the blow open condition of the circuit breaker in as rapid of a manner as possible, while ensuring that the contacts remain in the closed condition during normal operation of the circuit breaker.

BRIEF DESCRIPTION OF THE INVENTION

According to one aspect of the invention, a contact system of a circuit breaker includes a fixed contact. The contact system also includes at least one moveable contact arm assembly comprising a moveable contact arm having a moveable contact thereon, the moveable contact arm moveable to position the moveable contact into engagement with the fixed contact to define a closed condition and out of engagement with the fixed contact to define a blow open condition. The contact system further includes a carrier assembly operatively coupled to the moveable contact arm. The contact system yet further includes a latch plate operatively coupled to the carrier assembly. The contact system also includes a trip shaft operatively coupled to the carrier assembly, the trip shaft having a non-circular region defining an engagement surface disposed in contact with the latch plate in the closed condition. The contact system further includes a biasing portion of the moveable contact arm disposed proximate the trip shaft in the closed condition and configured to rotate the trip shaft out of engagement with the latch plate and into the blow open condition.

According to another aspect of the invention, a circuit breaker having a mechanism portion, a contact system portion and an arc chamber portion, the circuit breaker includes a first coupling member operatively coupled to a drive link of the mechanism portion, the first coupling member rotatable about a first shaft. The circuit breaker also includes a second coupling member pivotably coupled to the first coupling member and to a second shaft. The circuit breaker further includes a plurality of fixed contacts. The circuit breaker yet further includes a moveable contact arm assembly comprising a plurality of moveable contact arms, each of the plurality of moveable contact arms having a moveable contact disposed thereon, the moveable contact arm moveable to position each moveable contact into engagement with a respective fixed contact of the plurality of fixed contacts to define a closed condition and out of engagement with the plurality of fixed contacts to define a blow open condition. The circuit breaker also includes a carrier assembly operatively coupling the plurality of moveable contact arms to each other. The circuit breaker further includes a latch plate operatively coupled to the carrier assembly and to the second shaft. The circuit breaker yet further includes a trip shaft operatively coupled to the carrier assembly, the trip shaft having a non-circular region defining an engagement surface, the trip shaft disposed in contact with the latch plate in the closed condition. The circuit breaker also includes a biasing portion of one of the plurality of moveable contact arms, the biasing portion disposed proximate the engagement surface of the trip shaft in the closed condition and configured to rotate the trip shaft out of engagement with the latch plate.

These and other advantages and features will become more apparent from the following description taken in conjunction with the drawings.

BRIEF DESCRIPTION OF THE DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
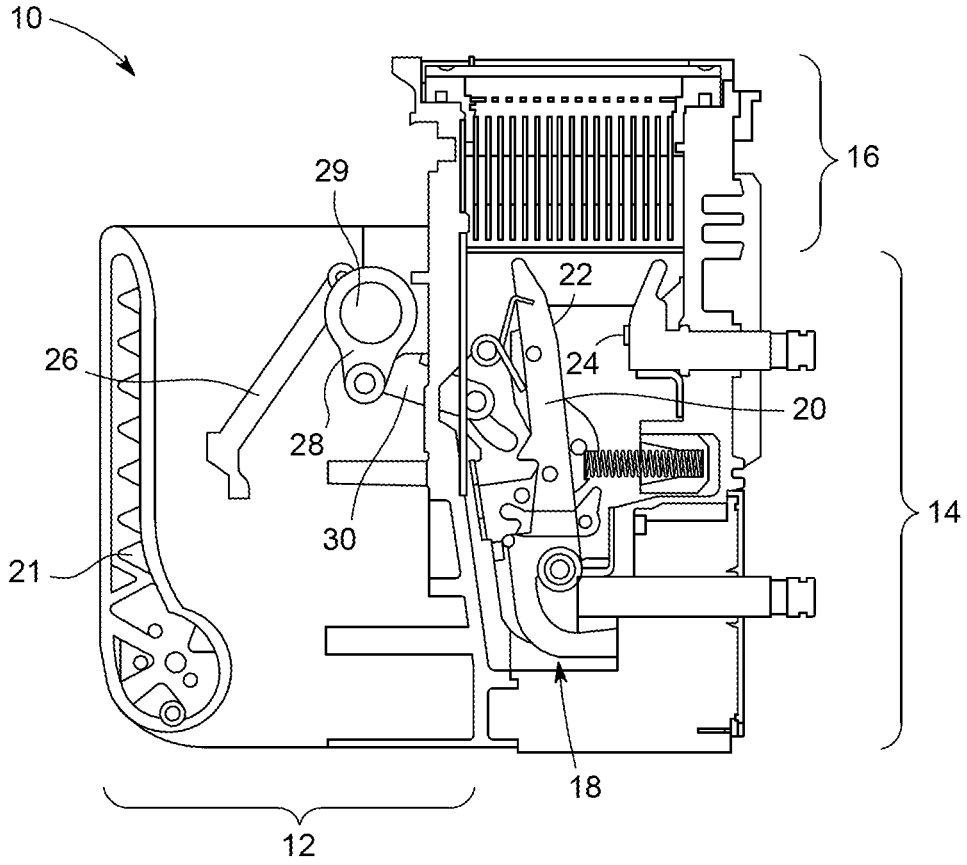
FIG. 1 is a side plan view of a circuit breaker.
Figure 5:
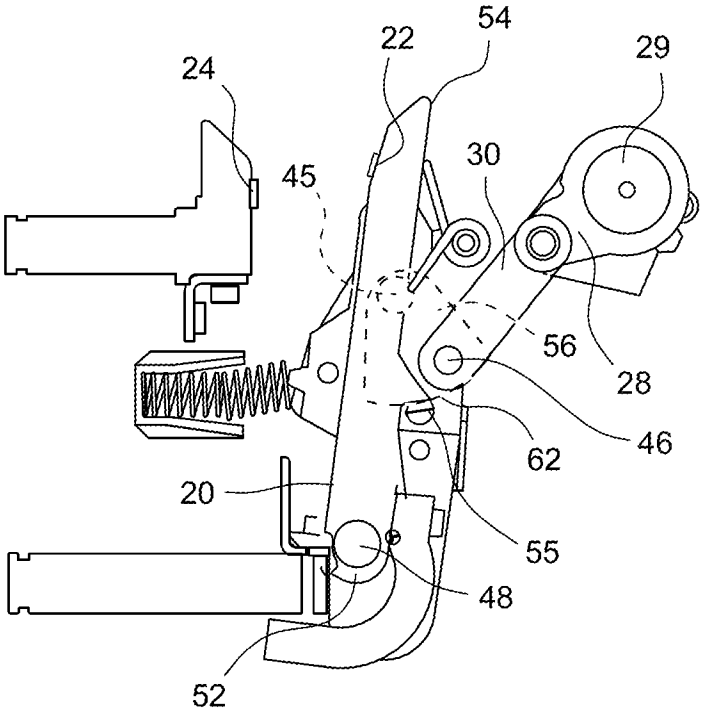
FIG. 5 is a side plan view of the circuit breaker in a blow open condition.
Figure 4:
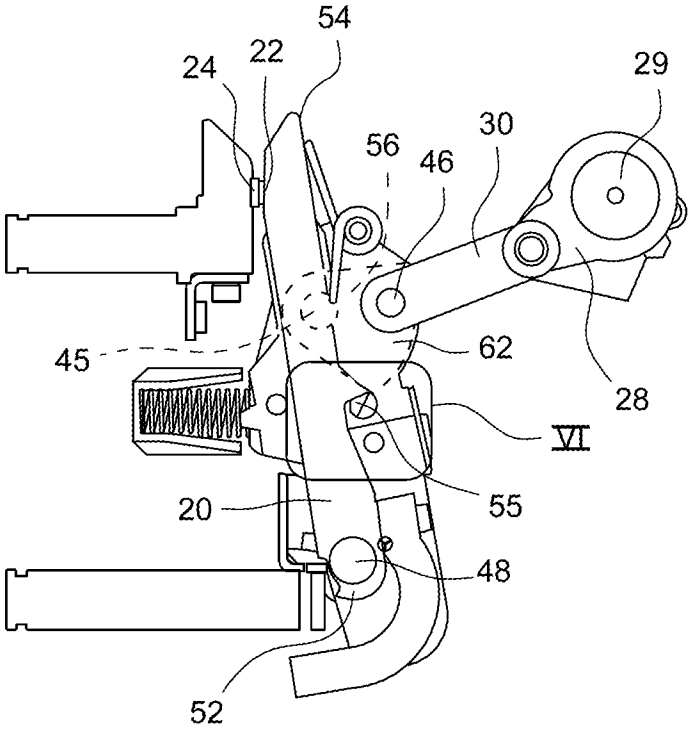
FIG. 4 is a side plan view of the circuit breaker in a closed condition.
Figure 7:
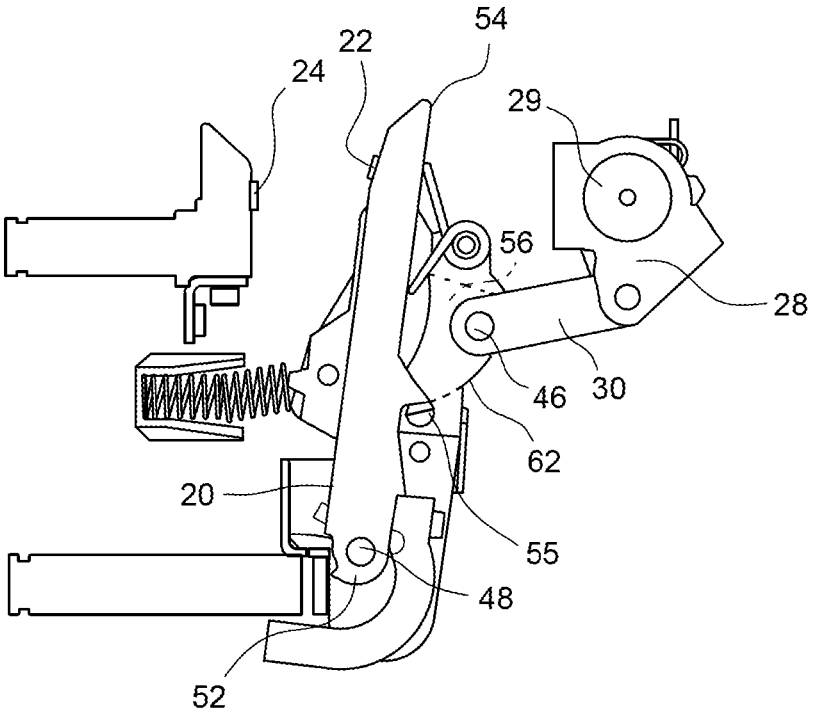
FIG. 7 is a side plan view of the circuit breaker in a fully open condition.

Referring to FIG. 1, a circuit breaker is illustrated and generally referenced with numeral 10. The circuit breaker includes a main mechanism portion 12, a contact system portion 14, and an arc chute portion 16. The contact system portion 14 includes a moveable contact arm assembly 18 that includes at least one, but typically a plurality of moveable contact arms 20. Each of the moveable contact arms 20 includes a moveable contact 22 disposed thereon and is positioned to be moved into an out of contact with a respective fixed contact 24. The connection facilitates connecting and disconnecting an electrical power source to an electrical load. Specifically, the circuit breaker 10 is said to be in a closed condition when the moveable contact 22 and the fixed contact 24 are in contact (FIG. 4). The circuit breaker 10 is said to be in a "blow open condition" when the moveable contact 22 and the fixed contact 24 are not in contact and spaced from each other (FIG. 5). The blow open condition occurs in response to a short circuit event. More particularly, a threshold electromagnetic force created by a short circuit forces the contact arm(s) to swing open before the mechanism 12 has time to respond. The threshold electromagnetic force is related to a threshold current level. In the blow open condition, a lay shaft 29 remains in a first rotational position that it is in during the closed condition described above. Upon activation of the mechanism 12 in response to a fault condition other than a short circuit event or subsequent to the blow open condition occurring, a resetting spring around the lay shaft 29 aids in moving a carrier assembly (described in detail below), to a fully open condition (FIG. 7). This condition may be referred to as a "trip condition." It is to be appreciated that the trip open condition is distinct from the blow open condition. Movement to the trip condition involves the tripping system in the mechanism being activated and rotating the lay shaft 29 to bring the carrier assembly into the fully open condition.

When referring to movement of the moveable contact arm assembly 18 to the fully open condition, this is done by the mechanism 12. Several components are involved in this actuation, with a drive link 26 being operatively coupled to a first coupling member 28 which is rotatable about the lay shaft 29, the first coupling member 28 operatively coupled to a second coupling member 30. The coupling relationship between the second coupling member 30 and the moveable contact arm assembly 18 will be described in detail below.

When referring to movement of the moveable contact arm assembly 18 to the blow open condition in response to a short circuit event, this occurs due to imposition of an electrodynamic force over a threshold level. It is desirable to force the circuit breaker 10 into the blow open condition in as short of a time period as possible. However, an electrodynamic field is present during operation of the circuit breaker, thereby imposing electrodynamic forces on the moveable contact(s) 22 and fixed contact(s) 24, but it is also desirable to retain the contacts together during forces below the aforementioned threshold level. The embodiments described herein facilitate desired retention of the contacts, while also providing a more rapid response time to a short circuit condition to quickly move the circuit breaker into the blow open condition.

Figure 3:
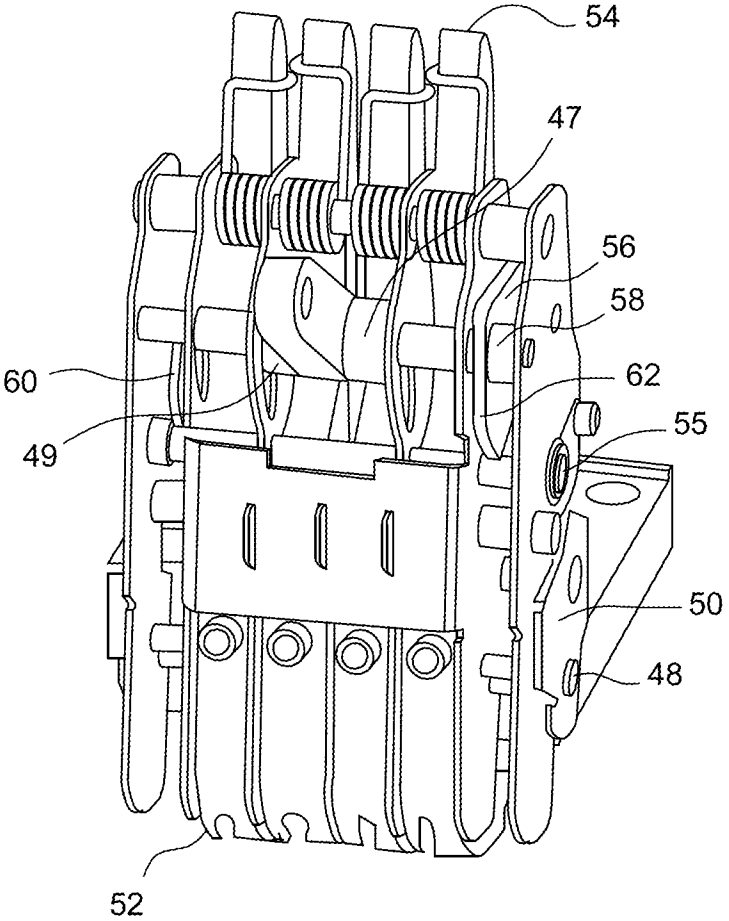
FIG. 3 is a perspective view of a moveable contact arm assembly operatively coupled to the carrier assembly.
Figure 2:
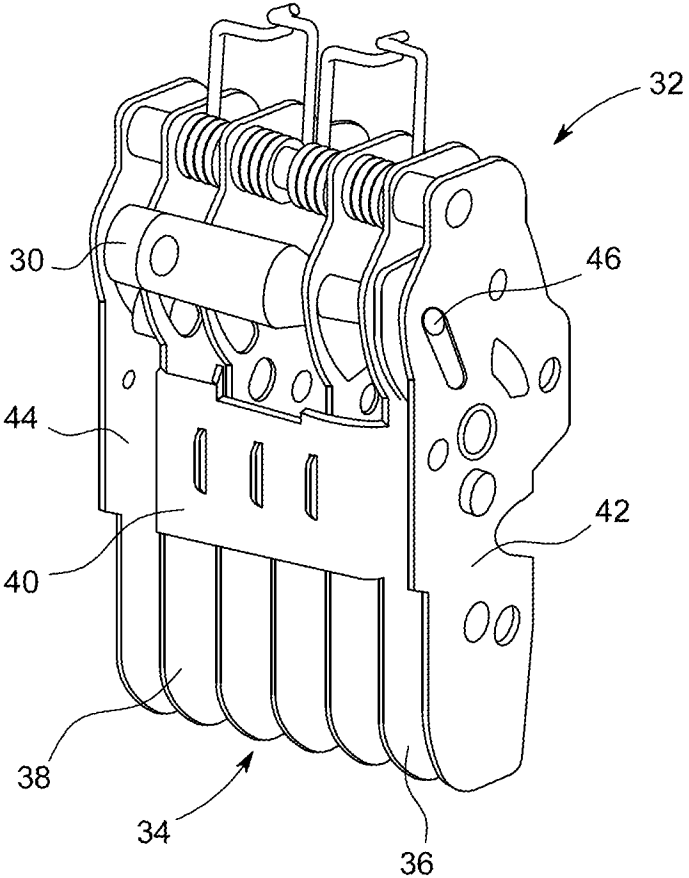
FIG. 2 is a partial perspective view of a carrier assembly of the circuit breaker.

Referring now to FIGS. 2 and 3, movement of the plurality of moveable contact arms 20 is facilitated by a carrier assembly 32. The carrier assembly 32 includes a plurality of separation brackets 34. The plurality of separation brackets 34 may be independent brackets or may be formed as a uniform assembly, such as in an integrally formed or operatively coupled manner. In the illustrated embodiment, two of the separation brackets, referred to as a first end bracket 36 and a second end bracket 38, are integrally formed, and joined by a U-bracket 40. Irrespective of the precise arrangement of the plurality of separation brackets 34, each of the brackets are disposed adjacent to at least one of the plurality of moveable contact arms 20 to separate the moveable contact arms 20. A first end plate 42 and a second end plate 44 are each disposed outwardly of the plurality of separation brackets 34. A second shaft 46 extends through the first end plate 42, the plurality of separation brackets 34, the second end plate 44, and the second coupling member 30. The second shaft 46 operatively couples the aforementioned components together and provides an axis about which the second coupling member 30 is rotatable about. As shown, additional shafts may be employed to further couple the components.

The second coupling member 30 is sized at the location of coupling to the second shaft 46 to be smaller than the space between the plurality of separation brackets 34 to avoid direct contact with the separation brackets. As shown best in FIG. 3, at least one spacer, such as a first spacer 47 and a second spacer 49 are disposed between the second coupling member 30 and the adjacent separation brackets. For example, the first spacer 47 is disposed between a first side of the second coupling member 30 and a first separation bracket and the second spacer 49 is disposed between a second side of the second coupling member 30 and a second separation bracket.

The plurality of moveable contact arms 20 are inserted between the plurality of separation brackets 34 and operatively coupled thereto by at least one shaft, such as a carrier shaft 48, which extends through the first end plate 42, the plurality of separation brackets 34, the second end plate 44, a bottom bracket 50, and the plurality of moveable contact arms 20. The plurality of moveable contact arms 20 is rotatable about the carrier shaft 48. In the illustrated embodiment, the axis about which the plurality of moveable contact arms 20 is rotatable about is located closer in proximity to a second end 52 of each contact arm relative to a first end 54 of the contact arms. The moveable contact 22 disposed on each contact arm is located closer in proximity to the first end 54 in the illustrated embodiment.

As shown in FIGS. 2-5, a trip shaft 55 extends through the first end plate 42, the plurality of separation brackets 34, and the second end plate 44, and is free to rotate independently of the components through which it extends. Also included is a first latch plate 56 operatively coupled to the shaft 46 and positioned between the first end plate 42 and the first end bracket 36. One or more bushings 58 may be included on the first latch plate 56 to reduce tilting of the first latch plate 56. Although a single latch plate is contemplated, it is to be appreciated that a second latch plate 60 is provided in some embodiments, such as the illustrated embodiment. The second latch plate 60 is also operatively coupled to the shaft second 46, but is positioned between the second end plate 44 and the second end bracket 38. Each of the latch plates pivot about a shaft 45 and may be formed of numerous contemplated geometries. In the illustrated embodiment, the latch plates 56, 60 are substantially wedge-shaped and have a curved end 62.

Figure 6:
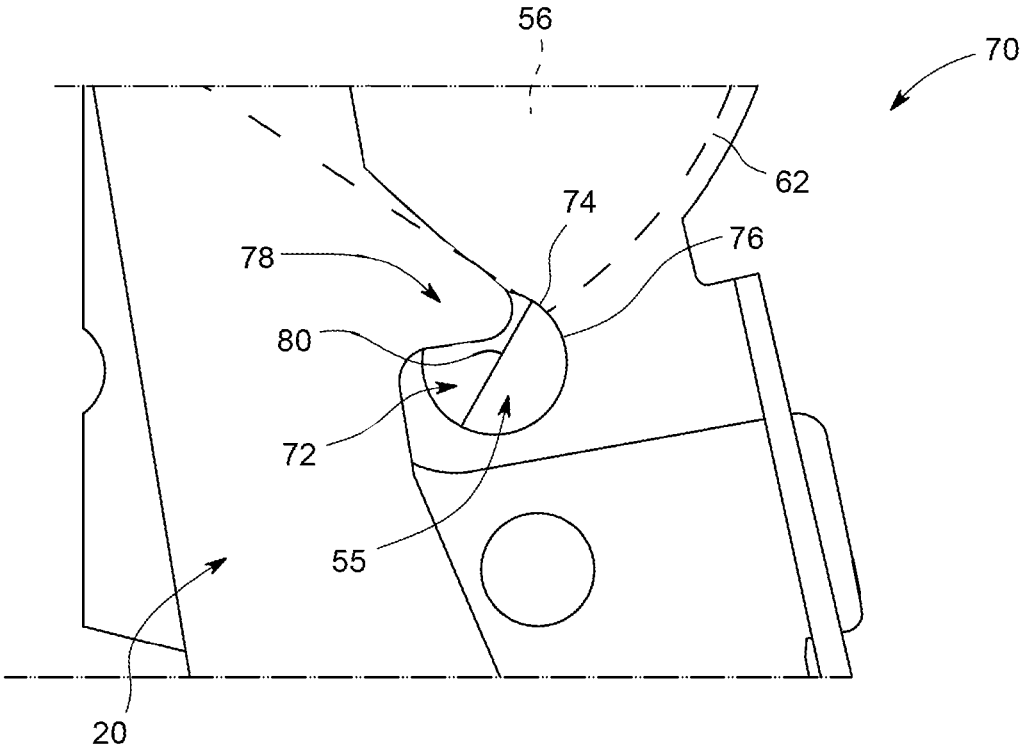
FIG. 6 is an enlarged view of Section VI illustrating a latching assembly of the moveable contact arm assembly.

Referring now to FIGS. 4-6, a latching assembly 70 is illustrated in greater detail, particularly in FIG. 6, which is an enlarged view. In particular, FIG. 6 illustrates greater detail of the trip shaft 55, the first latch plate 56, and a portion of one of the plurality of moveable contact arms 20. As will be appreciated from the description herein, the latching assembly 70 retains the plurality of moveable contact arms 20 in the closed condition of the circuit breaker 10 and facilitates a rapid opening of the circuit breaker 10 by providing a system that is responsive to lower threshold currents during a short circuit event, thereby reducing the time required by the circuit breaker 10 to reach the blow open condition.

At least a portion of the trip shaft 55 is formed of a non-circular geometry cross-section, referred to herein as a non-circular region 72. The non-circular region 72 includes an engagement surface 74 that is located along a curved portion 76 of the non-circular region 72. The engagement surface 74 is disposed in contact with the first latch plate 56 (and second latch plate 60 in some embodiments) when the circuit breaker 10 is in the closed condition. Each of the plurality of moveable contact arms 20 include a biasing portion 78 in the form of a protrusion that is disposed in close proximity to non-circular region 72 of the trip shaft 55 in the closed condition.

During operation of the circuit breaker, an electromagnetic force is generated at the contact location of the moveable contact 22 and the fixed contact 24, as described above. Upon reaching the predetermined threshold level, the electromagnetic force is sufficient to impart slight movement of the plurality of moveable contact arms 20. Upon such movement, the biasing portion 78 of at least one of the plurality of moveable contact arms 20 pushes against the non-circular region 72 of the trip shaft 55. It is contemplated that intermediate components may be included, such that the biasing portion 78 indirectly contacts the trip shaft 55. In the illustrated embodiment, the non-circular region comprises a substantially semi-circular geometry, with the curved portion 76 and a planar portion 80. In such an embodiment, the biasing portion 78 contacts and pushes against the planar portion 80 to impart rotation of the trip shaft 55. The rotation of the trip shaft 55 disengages the trip shaft 55 from the first latch plate 56 once the curved portion 72 of the trip shaft 55 is no longer in contact with the first latch plate 56. Disengagement causes the carrier assembly 32 to fully rotate the moveable contact arm assembly 18 to a sufficient position that achieves the blow open condition of the circuit breaker 10.

Advantageously, by utilizing the electromagnetic force to open the circuit breaker 10, a significant clearing time reduction is achieved. This assists in the current level rating of the circuit breaker in a smaller footprint, relative to other circuit breakers.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

What is claimed is:

1. A contact system of a circuit breaker comprising:

a fixed contact;

at least one moveable contact arm assembly comprising a moveable contact arm having a moveable contact thereon, the moveable contact arm moveable to position the moveable contact into engagement with the fixed contact to define a closed condition and out of engagement with the fixed contact to define a blow open condition;

a carrier assembly operatively coupled to the moveable contact arm;

a latch plate operatively coupled to the carrier assembly;

a trip shaft operatively coupled to the carrier assembly, the trip shaft having a non-circular region defining an engagement surface disposed in contact with the latch plate in the closed condition; and a biasing portion of the moveable contact arm disposed proximate the trip shaft in the closed condition and configured to rotate the trip shaft out of engagement with the latch plate and into the blow open condition.

2. The contact system of claim 1, wherein the non-circular region comprises a semi-circular geometry, the engagement surface of the non-circular region comprising a curved portion of the semi-circular geometry.

3. The contact system of claim 1, wherein the biasing portion of the moveable contact arm comprises a protrusion extending from the moveable contact arm toward the trip shaft.

4. The contact system of claim 1, wherein the contact system retains the contacts in the closed condition at electromagnetic force levels lower than a threshold level and moves the circuit breaker into the blow open condition upon reaching the threshold level.

5. The contact system of claim 1, wherein the moveable contact arm comprises a first end and a second end, the moveable contact arm pivotable about an axis located proximate the second end.

6. The contact system of claim 5, wherein the moveable contact disposed on the moveable contact arm is located closer in proximity to the first end than the second end of the moveable contact arm.

7. The contact system of claim 5, wherein the carrier assembly is operatively coupled to the moveable contact arm with a carrier shaft positioned coaxially with the axis located proximate the second end of the moveable contact arm.

8. A circuit breaker having a mechanism portion, a contact system portion and an arc chamber portion, the circuit breaker comprising:

a first coupling member operatively coupled to a drive link of the mechanism portion, the first coupling member rotatable about a first shaft;

a second coupling member pivotably coupled to the first coupling member and to a second shaft;

a plurality of fixed contacts;

a moveable contact arm assembly comprising a plurality of moveable contact arms, each of the plurality of moveable contact arms having a moveable contact disposed thereon, the moveable contact arm moveable to position each moveable contact into engagement with a respective fixed contact of the plurality of fixed contacts to define a closed condition and out of engagement with the plurality of fixed contacts to define a blow open condition;

a carrier assembly operatively coupling the plurality of moveable contact arms to each other;

a latch plate operatively coupled to the carrier assembly and to the second shaft;

a trip shaft operatively coupled to the carrier assembly, the trip shaft having a non-circular region defining an engagement surface disposed in contact with the latch plate in the closed condition; and a biasing portion of one of the plurality of moveable contact arms, the biasing portion disposed proximate the trip shaft in the closed condition and configured to rotate the trip shaft out of engagement with the latch plate.

9. The circuit breaker of claim 8, wherein the non-circular region comprises a semi-circular geometry, the engagement surface of the non-circular region comprising a curved portion of the semi-circular geometry.

10. The circuit breaker of claim 8, wherein the biasing portion comprises a protrusion extending from one of the plurality of moveable contact arms toward the trip shaft.

11. The circuit breaker of claim 8, wherein interaction of the latch plate, trip shaft, and biasing portion facilitates retention at electromagnetic force levels lower than a threshold level and moves the circuit breaker into the blow open condition upon reaching the threshold level.

12. The circuit breaker of claim 8, wherein each of the plurality of moveable contact arms comprises a first end and a second end, each of the plurality of moveable contact arms pivotable about an axis located proximate the second end.

13. The circuit breaker of claim 12, wherein the moveable contact disposed on each of the plurality of moveable contact arms is located closer in proximity to the first end than the second end.

14. The circuit breaker of claim 12, wherein the carrier assembly is operatively coupled to the plurality of moveable contact arms with a carrier shaft positioned coaxially with the axis located proximate the second end of the plurality of moveable contact arms.

15. The circuit breaker of claim 8, wherein the carrier assembly comprises a plurality of separation brackets operatively coupled to each other and to the second shaft, each of the plurality of separation brackets disposed adjacent at least one of the plurality of moveable contact arms, the circuit breaker further comprising:

a first end plate located at a first side of the carrier assembly and operatively coupled to the second shaft; and a second end plate located at a second side of the carrier assembly and operatively coupled to the second shaft.

16. The circuit breaker of claim 15, wherein the latch plate is operatively coupled to the first end plate and disposed between the first end plate and one of the plurality of separation brackets.

17. The circuit breaker of claim 16, further comprising an additional latch plate operatively coupled to the second end plate and disposed between the second end plate and one of the plurality of separation brackets.

18. The circuit breaker of claim 15, further comprising at least one spacer disposed between the second coupling member and one of the plurality of separation brackets.

19. The circuit breaker of claim 18, wherein the at least one spacer comprises a first spacer and a second spacer, the first spacer disposed between a first side of the second coupling member and a first separation bracket, the second spacer disposed between a second side of the second coupling member and a second separation bracket.

* * * * *